US008974178B2

(12) United States Patent
Stoicescu et al.

(10) Patent No.: US 8,974,178 B2
(45) Date of Patent: Mar. 10, 2015

(54) FUEL SYSTEM CENTRIFUGAL BOOST PUMP VOLUTE

(75) Inventors: Adrian L. Stoicescu, Roscoe, IL (US); Steven A. Heltz, Rockford, IL (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 575 days.

(21) Appl. No.: 13/351,936

(22) Filed: Jan. 17, 2012

(65) Prior Publication Data

US 2013/0183148 A1 Jul. 18, 2013

(51) Int. Cl.
*F04D 29/42* (2006.01)

(52) U.S. Cl.
USPC ..... 415/204

(58) Field of Classification Search
USPC ..... 415/203, 204, 206; 29/888.022, 29/888.024
See application file for complete search history.

(56) References Cited

U.S. PATENT DOCUMENTS

| | | | | | |
|---|---|---|---|---|---|
| 4,067,665 | A | * | 1/1978 | Schwartzman | 417/245 |
| 4,946,348 | A | | 8/1990 | Yapp | |
| 5,127,800 | A | | 7/1992 | Hyll et al. | |
| 5,156,534 | A | | 10/1992 | Burgy et al. | |
| 5,332,359 | A | | 7/1994 | Palgon et al. | |
| 5,743,710 | A | | 4/1998 | Yapp | |
| 5,797,724 | A | * | 8/1998 | Liu et al. | 415/206 |
| 5,813,833 | A | * | 9/1998 | Addie et al. | 415/206 |
| 5,915,921 | A | | 6/1999 | Sabini | |
| 6,039,549 | A | | 3/2000 | Tarng et al. | |
| 6,050,772 | A | * | 4/2000 | Hatakeyama et al. | 415/1 |
| 6,953,321 | B2 | * | 10/2005 | Roudnev et al. | 415/197 |
| 7,412,831 | B2 | | 8/2008 | Ullyott | |
| 8,052,384 | B2 | | 11/2011 | Blewett et al. | |
| 2005/0281669 | A1 | * | 12/2005 | Sohn et al. | 415/204 |

* cited by examiner

*Primary Examiner* — Liam McDowell
(74) *Attorney, Agent, or Firm* — Carlson, Gaskey & Olds, P.C.

(57) ABSTRACT

A disclosed centrifugal boost pump volute includes normal to flow cross sectional surfaces distributed over the length of the passage. The volute includes a volute proper, an exit bend and a diffuser fluidly interconnecting the volute proper to the exit bend. The cross sectional surfaces are defined as dimensions set out in one set of data, which includes Tables N-1 and N-2 for the volute proper and Table N-3 for the volute exit bend, where N is the same value.

9 Claims, 6 Drawing Sheets

FUEL SYSTEM CENTRIFUGAL BOOST PUMP VOLUTE

BACKGROUND

This disclosure relates to an aircraft jet engine mounted fuel centrifugal boost pump, for example, in particular to the centrifugal boost pump volute.

The centrifugal boost pump is commonly packaged together with the main fuel pump, which is usually of a positive displacement gear pump type, both being driven by a common shaft. The fuel leaving the boost stage goes through a filter and a fuel oil heat exchanger before entering the main pump. Pressure losses are introduced by these components and the associated plumbing, while heat is also added to the fuel. The fuel feeding the centrifugal boost pump comes from the main frame fuel tanks through the main frame plumbing. The tanks are usually vented to the ambient atmospheric pressure, or, in some cases, are pressurized a couple of psi above that. The tanks are provided with immersed pumping devices, which are in some cases axial flow pumps driven by electric motors or turbines, or in other cases ejector pumps, collectively referred to as main frame boost pumps.

During flight, the pressure in the tank decreases with altitude following the natural depression in the ambient atmospheric pressure. Under normal operating conditions, industry standards require the main frame boost pumps to provide uninterrupted flow to the engine mounted boost pumps at a minimum of 5 psi above the true vapor pressure of the fuel and with no V/L (vapor liquid ratio) or no vapor present as a secondary phase. Under abnormal operation, which amounts to inoperable main frame boost pumps, the pressure at the inlet of the boost stage pumps can be only 2, or 3 psi above the fuel true vapor pressure, while vapor can be present up to a V/L ratio of 0.45, or more. Definition of terms, recommended testing practices, and fuel physical characteristics are outlined in industry specifications and standards like Coordinating Research Council Report 635, AIR 1326, (SAE Aerospace Information Report), SAE ARP 492 (SAE Aerospace Recommended Practices), SAE ARP 4024, (SAE Aerospace Recommended Practices), ASTM D 2779, (American Society for Testing and Materials), and ASTM D 3827 (American Society for Testing and Materials), for example.

During normal or abnormal operation, the centrifugal boost pump is required to maintain enough pressure at the main pump inlet under all the operating conditions encountered in a full flight mission such as the main pump can maintain the demanded output flow and pressure to the fuel control and metering unit for continuous and uninterrupted engine operation. There are also limitations in the maximum pressure rise the engine mounted centrifugal boost pump is allowed to deliver such not to exceed the mechanical pressure rating of the fuel oil heat exchanger, or limitations pertaining to minimum impeller blade spacing such as a large contaminant like a bolt lost from maintenance interventions would pass through and be trapped safely in the downstream filter. All these requirements along with satisfying a full flow operating range from large flows during takeoff to a trickle of flow during flight idle descent, and fuel temperature swings from −40 F to 300 F, makes the aerodynamic design of the engine mounted fuel pumps a serious challenge.

The volute collects the flow which is leaving the impeller in an almost tangential direction and with high velocities close to that of the impeller tip tangential velocity and directs it to the pump discharge port. From the pump inlet to the impeller exit port, the only element which adds power to the fluid is the impeller. The power is supplied at the shaft by the pump driver. A successful pump is expected to deliver the flow at the pump discharge port with relatively low velocities, at the required pressure rise above pump inlet pressure and with the best efficiency possible.

In general, impellers by themselves present high efficiencies between 75% and 95% depending on the pump size in terms of flow and running speed. The flow stream leaving the impeller exit port, aside from containing potential energy in the form of static pressure, also contains a fair amount of kinetic energy due to the high velocity of the fluid stream. Hence, in order to achieve a high overall efficiency for the entire pump, the volute must provide a high degree of pressure recovery, or transfer as much kinetic energy as possible into potential energy, or static pressure. To achieve this goal, the volute cross section is progressively increased in the direction of flow, which forces the fluid stream to slow down and, in the process, energy is recovered in the form of pressure.

The volute is composed of three distinct sections. The first section, which wraps around the impeller exit port, is called the volute proper. The second section, which usually is a straight tapered segment with a roundish cross section, is called a diffuser. The last section, which turns the flow from a normal plane relative to the impeller axis to an axial direction, is called exit bend. The need for the exit bend is dictated by the specific requirements of a given application.

SUMMARY

A disclosed boost pump volute includes normal to flow cross sectional surfaces distributed over the length of the passage. The volute includes a volute proper, an exit bend and a diffuser fluidly interconnecting the volute proper to the exit bend. The cross sectional surfaces are defined as dimensions set out in one set of data, which includes Tables N-1 and N-2 for the volute proper and Table N-3 for the volute exit bend, where N is the same value.

BRIEF DESCRIPTION OF THE DRAWINGS

The disclosure can be further understood by reference to the following detailed description when considered in connection with the accompanying drawings wherein.

DETAILED DESCRIPTION

Figures 1, 2:
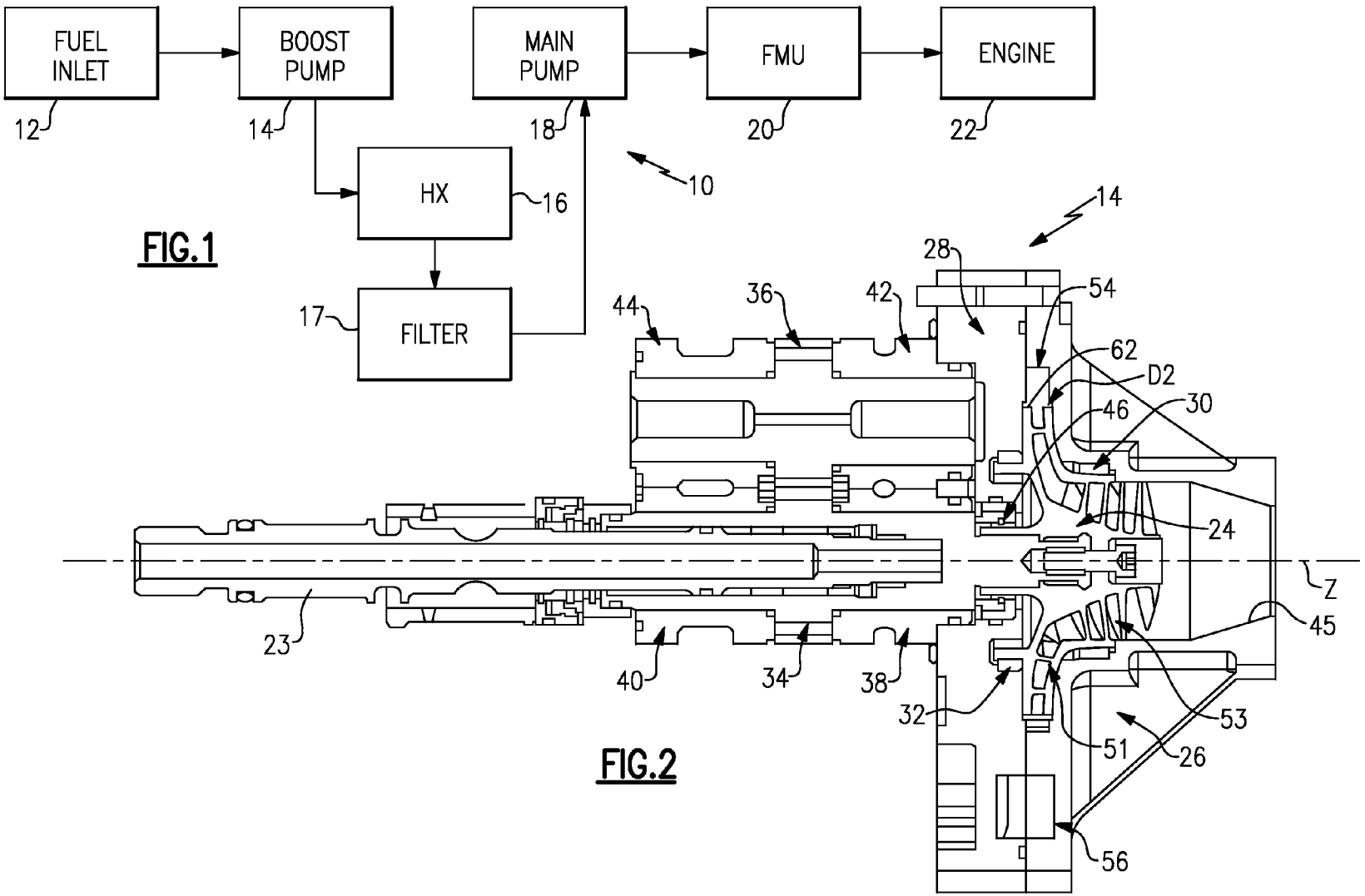
FIG. 1 is a schematic of an example fuel delivery system.
FIG. 2 is a cross-sectional view of the engine mounted boost pump.

A schematic of an example of engine mounted fuel delivery system, for example, for an aircraft, is illustrated in FIG. 1. The system 10 includes a fuel inlet 12 that is fluidly connected to airframe plumbing at engine airframe interface. Fuel is delivered to this interface from the aircraft fuel tanks by means of airframe mounted fuel pumps. A boost pump 14 pressurizes the fuel before providing the fuel to the main pump 18. Typically, a filter 17 and a heat exchanger 16 are installed in between the boost pump 14 and the main pump 18. Fuel from the main pump 18 is regulated by a fuel metering unit 20, which supplies pressure regulated fuel to the engine 22.

FIG. 2 shows a cross-sectional view of an example engine-mounted boost and main fuel pump having the longitudinal axis, which corresponds to an axis Z. Only the boost pump 14 is illustrated in FIG. 2. The boost pump 14 includes a shrouded impeller 24 rotationally driven by a shaft 23, which is typically driven by a gearbox mounted on the engine. The impeller 24 is arranged between a boost housing cover 26 and a center plate 28. Front and rear labyrinth seals 30, 32 respectively seal between the impeller 24 and the boost housing cover 26 and center plate 28. A rear side face seal 46 is also provided between the center plate 28 and the impeller 24 in the example shown.

The shaft 23 is splined to a drive gear 34, which is coupled to and rotationally drives a driven gear 36. A drive gear floating bearing 38 and a drive gear fixed bearing 40 support the drive gear 34. A driven gear floating bearing 42 and a driven gear fixed bearing 44 support the driven gear 36.

During operation, fuel flow enters through the inlet from the far right side opening 45 of the boost pump housing cover 26 flowing axially from right to left. The fuel flow then enters first the inducer section 53 of the rotating impeller 24 where the pressure is raised and the eventual air and vapor phase present in the mixture are compressed back in to solution such by the time the fuel flow reaches the impeller section 51 most of the mixture is in the liquid phase. The fuel flow then enters the impeller section 51 where the majority of the pressure rise takes place, while the fluid absolute velocity is greatly increased. The fuel flow leaves the impeller 24 at its outside diameter exit port, or perimeter 62, under significantly larger pressure and with large velocity in an almost tangential direction. At this location, the flow stream contains potential energy based on the actual static pressure and a good amount of kinetic energy due to the high flow velocity.

It is the purpose of the volute to gradually capture this flow stream, progressively slow its velocity down and guide it towards the boost pump discharge port. By slowing down the flow stream velocity in a smooth way and without generating of any eddies, the majority of the kinetic energy of the flow stream is transformed into potential energy, or pressure. At the exit port of the boost pump, flow is delivered to the downstream system at much higher pressure than that from the boost pump inlet and with a relatively low velocity commonly used in the fuel system plumbing to deliver the fuel flow throughout the system.

Figure 6:
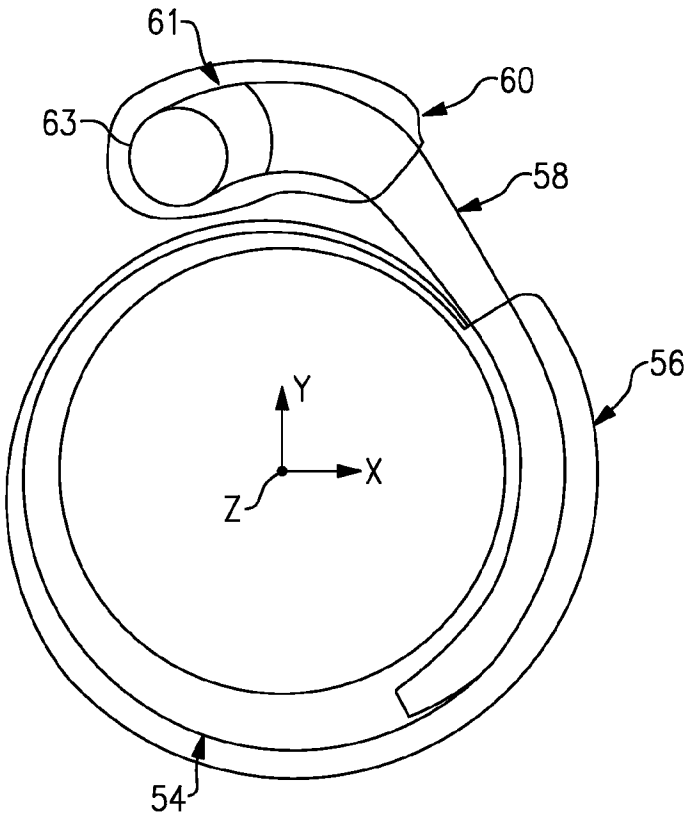
FIG. 6 is another perspective view of the volute fluid volume with outlined area depicting the volute proper, volute exit bend, and the diffuser.
Figure 5:
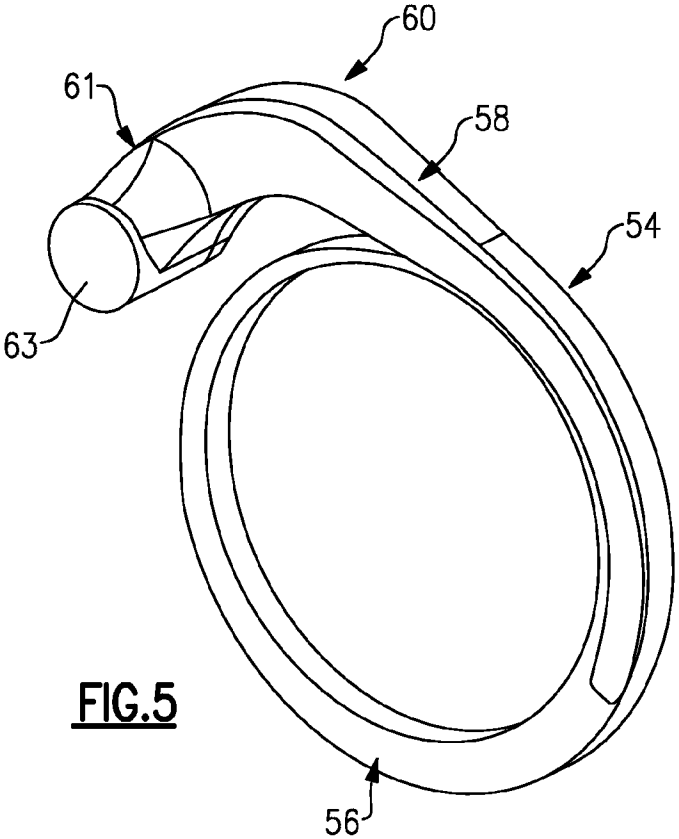
FIG. 5 is a perspective view of a boost the volute fluid volume.
Figure 7A:
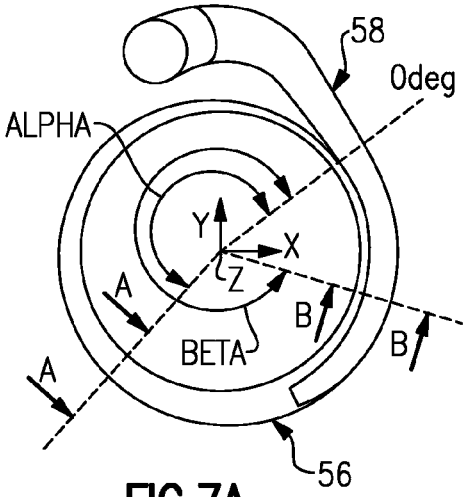
FIG. 7A is a volute geometry-dimensioning scheme.
Figure 7B:
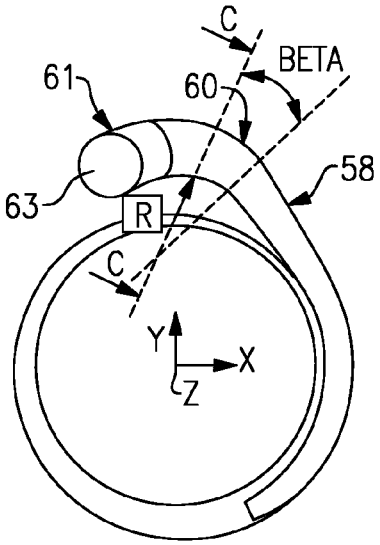
FIG. 7B is another aspect of the volute geometry-dimensioning scheme shown in FIG. 7A, including a volute exit bend geometry-dimensioning scheme.

FIGS. 5 and 6 show a perspective view respectively front view of the fluid zone of the volute. The volute 54 consists of the volute proper 56, the diffuser 58 and the volute exit bend 60. A terminal end 61 includes an exit port 63, which are typically determined by customer requirements. Generally, the volute proper 56 starts at the minimum radial spacing between the impeller 24 and the volute 54 and follows an increased cross-sectional area around the impeller perimeter 62 to, for example, a full 360 degrees. The shape of the cross-sections are progressively changed to accommodate space constraints and, or, ease of manufacturing constraints. The fluid stream velocity in the volute 54 is progressively reduced from the high tangential velocities leaving the impeller 24 to about half of that at the start of the diffuser 58. The interface between the volute proper 56 and the diffuser section 58 is called a throat. The diffuser 58 is a straight section of continuously increasing area, where the fluid stream velocity is further reduced to half, or a third of its value at the throat. The volute exit bend 60 is intended to make the transition between the diffuser 58 and the pump exit port 63. Usually, this section consists of a double turn.

Figure 4:
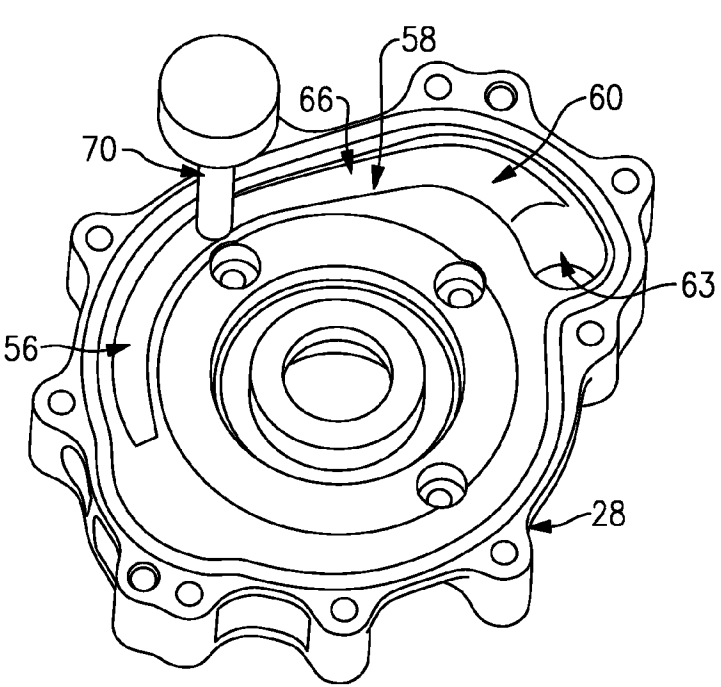
FIG. 4 is a view of the boost stage center plate. The tool cutter is also shown here.
Figure 3:
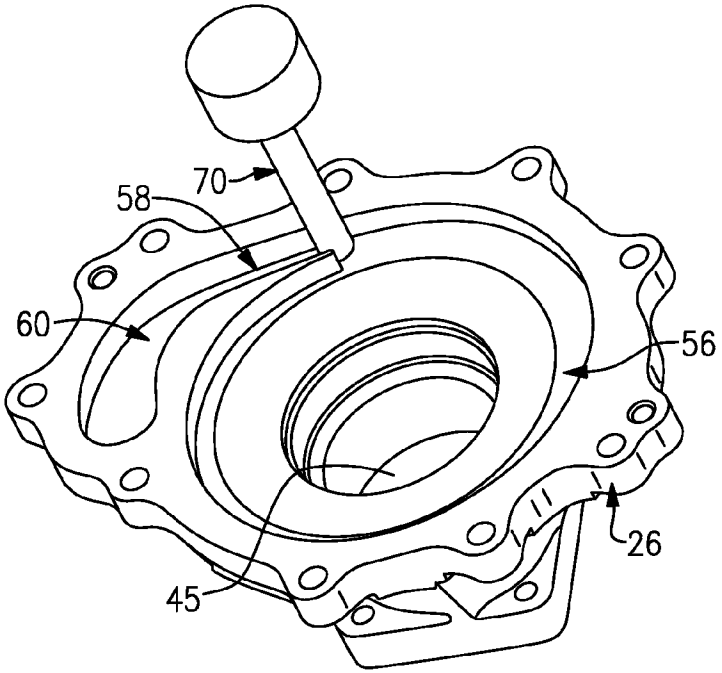
FIG. 3 is a perspective view of the boost stage housing cover showing the volute and a tool cutter used in a milling operation.

FIGS. 3 and 4 show the boost pump cover 26 and the center plate 28, which both contain portions 64, 66 of the volute passages. The volute may be machined by using only one cutter 70 on a four-axis milling center, for example. The volute can be cast or machined. In the example, the volute 54 is split into two sections by an imaginary plane P normal to the pump axis of rotation, which is the Z-axis. The first portion 64 is machined into the boost stage housing cover 26, while the second portion 66 is machined in the center plate 28, which separates the boost pump from the main pump. In the example, the shape of the volute 54 is designed in such a way to allow for the complete machining of the volute passages by means of using only one end mill cutter on a four-axis milling machine, which reduces cost and increases productivity. As a result of this approach, a better control is maintained on the size and shape of the volute 54 along with obtaining a better surface finish, which translates into higher efficiencies and pressure recovery.

Figure 8A:
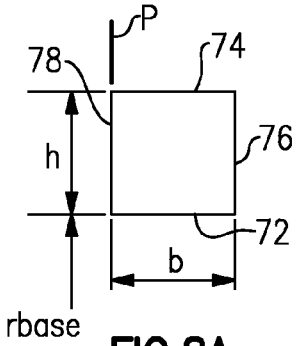
FIG. 8A is a cross-sectional view taken along line A-A in FIG. 7A.
Figure 8B:
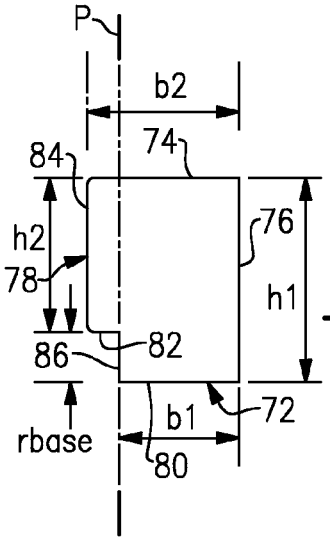
FIG. 8B is a cross-sectional view taken along line B-B in FIG. 7A.

FIGS. 7A-7B and 8A-8C show the typical cross-sections defining the volute geometry. The first and second housing portions are provided by the boost pump housing cover 26 and center plate 28 and mate with one another along a plane P, which is perpendicular to the rotational axis Z of the impeller 24. The cross-sections of the volute proper 56 are shown in FIGS. 8A and 8B and represented by the data in Tables N-1 and N-2, wherein N represents one set of data for a given volute. That is, Tables 1-1, 1-2, 1-3 represent data for one example volute (FIGS. 7A-8C); Tables 2-1, 2-2, 2-3 represent data for another example volute (FIGS. 9A-10C); Tables 3-1, 3-2, 3-3 represent data for yet another example volute (FIGS. 11A-12C).

The volute 54 is defined by inner and outer arcuate walls 72, 74 that are radially spaced from one another. The radius "r base" from the axis Z defines the inner arcuate wall 72 and is provided as a ratio to an impeller outer diameter D2 throughout this disclosure (see FIG. 2). The zero degree starting point, which corresponds to the"'0' section number" in the Tables, corresponds to the intersection of the volute proper 56 and the diffuser 58. The sections in Tables N-1 and N-2 are provided at degree positions "alpha."

First and second axial spaced walls 76, 78 adjoin the inner and outer arcuate walls 72, 74 to provide a generally quadrangular cross-section. One or more of the corners of this quadrangular cross-section may include a radius, which in one example is 0.032 in (0.81 mm). In a first portion of the volute proper 56, represented by section A-A in FIG. 8A, the inner and outer arcuate walls 72, 74 have a common dimension "b," and the first and second axial walls 76, 78 have a common dimension "h." The dimensions b, h are provided as a ratio to an impeller outer diameter D2 throughout this disclosure. The second axial wall 78 lies in the plane P in the first portion.

In a second portion of the volute proper 56, represented by section B-B in FIG. 8B, a circumferentially enlarging tapered pocket is provided. More specifically, the outer arcuate wall 74 includes a dimension "b2," and the first axial wall 76 includes a dimension "h1." The first arcuate wall 72 includes first and second inner portions 80, 82, wherein the first inner portion 80 adjoins the first axial wall 76 and includes a dimension "b1." The second axial wall 78 includes first and second axial portions 84, 86, wherein the first axial portion 84 adjoins the outer arcuate wall 74 and includes a dimension "h2." Together the second inner and axial portions 82, 86 provide a recessed step relative to h1 and b2, and the second axial portion 86 lies in the plane P. The dimensions b1, b2, h1, h2 are provided as a ratio to an impeller outer diameter D2 throughout this disclosure.

Figure 8C:
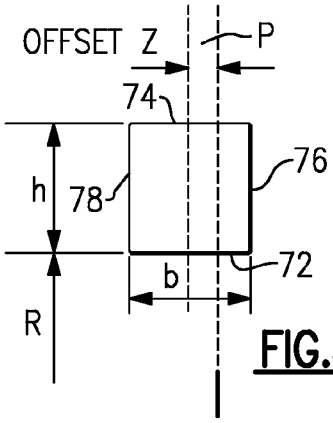
FIG. 8C is a cross-sectional view taken along line C-C in FIG. 7B.
Figure 9A:
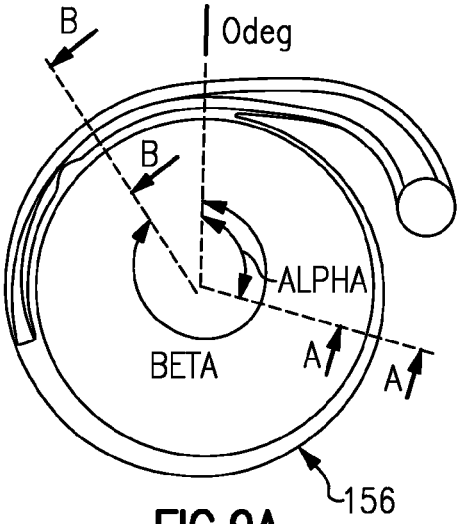
FIG. 9A is another volute geometry-dimensioning scheme.
Figure 9B:
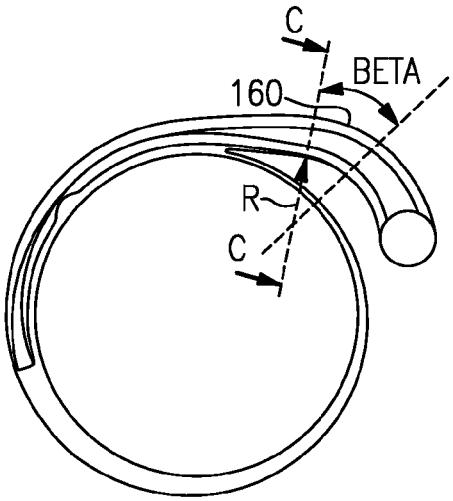
FIG. 9B is another aspect of the volute geometry-dimensioning scheme shown in FIG. 9A, including a volute exit bend geometry-dimensioning scheme.

The volute exit bend 60 is illustrated by the section C-C in FIG. 8C, which is provided by the inner and outer arcuate walls 72, 74 and the first and second axial walls 76, 78. The "offset Z" corresponds to the axial offset from the plane P in the Z-direction and is the axial midpoint between the first and second axial walls 76, 78. The diffuser 58 is defined by straight lines interconnecting section 0/36 from volute proper 56 to the "section 1" of the volute exit bend 60. The inner arcuate wall 72 in the diffuser 58 is normal to plane taken in the 0/360 section number, which is perpendicular to the flow direction. The inner arcuate wall 72 in the volute exit bend 60 lies along a radius R in the volute exit bend 60 rather than in the radius "r base." The sections are provided at section numbers taken at degree locations "beta."

FIGS. 9A-9B and 10A-10C show the typical cross-sections defining another volute geometry. First and second axial spaced walls 176, 178 adjoin the inner and outer arcuate walls 172, 174 to provide a generally quadrangular cross-section. One or more of the corners of this quadrangular cross-section may include a radius, which in one example is 0.032 in (0.81 mm). In a first portion of the volute proper 156, represented by section A-A in FIG. 10A, the inner and outer arcuate walls 172, 174 have a common dimension "b," and the first and second axial walls 176, 178 have a common dimension "h." The second axial wall 178 lies in the plane P in the first portion.

Figure 10A:
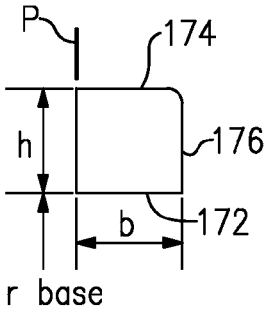
FIG. 10A is a cross-sectional view taken along line A-A in FIG. 9A.
Figure 10B:
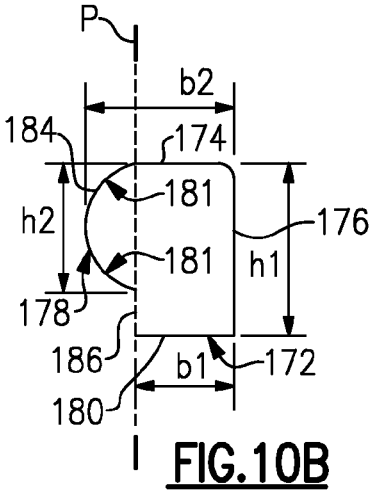
FIG. 10B is a cross-sectional view taken along line B-B in FIG. 9A.

In a second portion of the volute proper 156, represented by section B-B in FIG. 10B, a circumferentially enlarging tapered pocket is provided. More specifically, the outer arcuate wall 174 includes a dimension "b2," and the first axial wall 176 includes a dimension "h1." The first arcuate wall 172 includes first and second inner portions 180, 182, wherein the first inner portion 180 adjoins the first axial wall 176 and includes a dimension "b1." The second axial wall 178 includes first and second axial portions 184, 186, wherein the first axial portion 184 adjoins the outer arcuate wall 174 and includes a dimension "h2." The first action portion 184 is arcuate in shape and is provided by radii 181, which are 1.250 inch (31.75 mm) in the example. Together the second inner and axial portions 182, 186 provide a recessed step relative to h1 and b2, and the second axial portion 186 lies in the plane P.

Figure 10C:
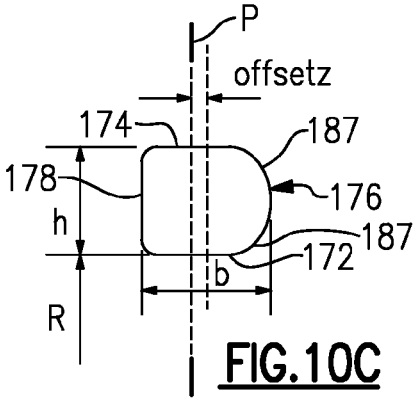
FIG. 10C is a cross-sectional view taken along line C-C in FIG. 9B.
Figure 11A:
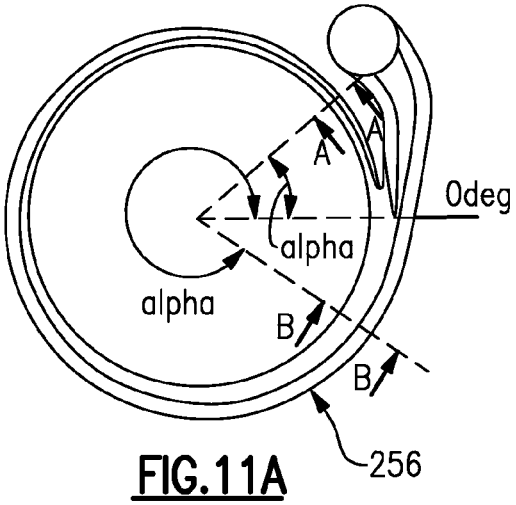
FIG. 11A is yet another volute geometry-dimensioning scheme.

The volute exit bend 160 is illustrated by the section C-C in FIG. 10C, which is provided by the inner and outer arcuate walls 172, 174 and the first and second axial walls 176, 178. The first arcuate wall 176 is curved and is provided by radii 187, which are 0.125 inch (3.18 mm) in the example. The "offset Z" corresponds to the axial offset from the plane P in the Z-direction and is the axial midpoint between the first and second axial walls 176, 178. The diffuser 158 is defined by straight lines interconnecting section 0/36 from volute proper 156 to the "section 1" of the volute exit bend 160. The inner arcuate wall 172 in the diffuser 158 is normal to plane taken in the 0/360 section number, which is perpendicular to the flow direction. The inner arcuate wall 172 in the volute exit bend 160 lies along a radius R in the volute exit bend 160 rather than in the radius "r base." The sections are provided at section numbers taken at degree locations "beta."

FIGS. 11A-11B and 12A-12C show the typical cross-sections defining another volute geometry. First and second axial spaced walls 276, 278 adjoin the inner and outer arcuate walls 272, 274 to provide a generally quadrangular cross-section. The second arcuate wall 274 includes a centrally located rounded recess 283, which is provided by a radius of 0.156 inch (3.97 mm) in one example. One or more of the corners of this quadrangular cross-section may include a radius, which in one example is 0.032 in (0.81 mm). In a first portion of the volute proper 256, represented by section A-A in FIG. 12A, the inner and outer arcuate walls 272, 274 have a common dimension "b," and the first and second axial walls 276, 278 have a common dimension "h." The second axial wall 278 lies in the plane P in the first portion.

Figure 12A:
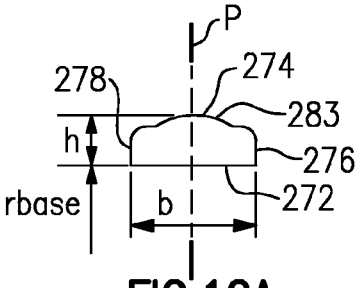
FIG. 12A is a cross-sectional view taken along line A-A in FIG. 11A.
Figure 12B:
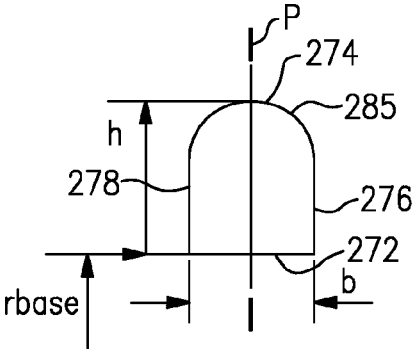
FIG. 12B is a cross-sectional view taken along line B-B in FIG. 11A.
Figure 11B:
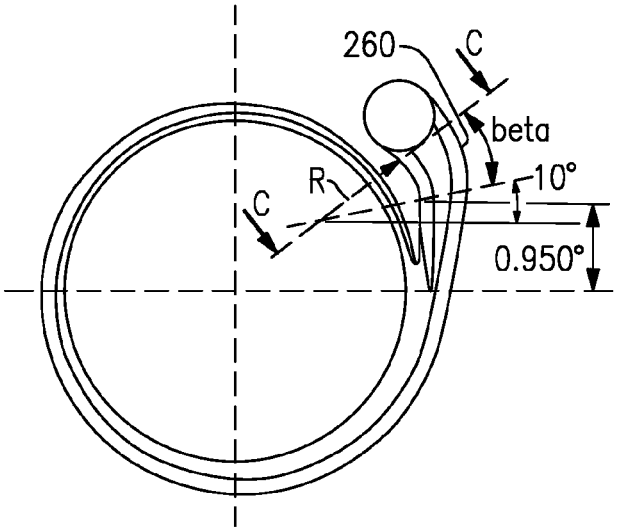
FIG. 11B is another aspect of the volute geometry-dimensioning scheme shown in FIG. 11A, including a volute exit bend geometry-dimensioning scheme.

In a second portion of the volute proper 256, represented by section B-B in FIG. 12B, a circumferentially enlarging tapered pocket is provided. More specifically, the outer arcuate wall 274 includes a dimension "b2," and the first axial wall 276 includes a dimension "h1." The first arcuate wall 272 includes first and second inner portions 280, 282, wherein the first inner portion 280 adjoins the first axial wall 276 and includes a dimension "b1." The second axial wall 278 includes first and second axial portions 284, 286, wherein the first axial portion 284 adjoins the outer arcuate wall 274 and includes a dimension "h2." Together the second inner and axial portions 282, 286 provide a recessed step relative to h1 and b2, and the second axial portion 286 lies in the plane P. The second arcuate wall 274 maintains the rounded recess 285 in the second portion of the volute proper 256, which is provided by a radius of 0.156 inch (3.97 mm) in one example.

Figure 12C:
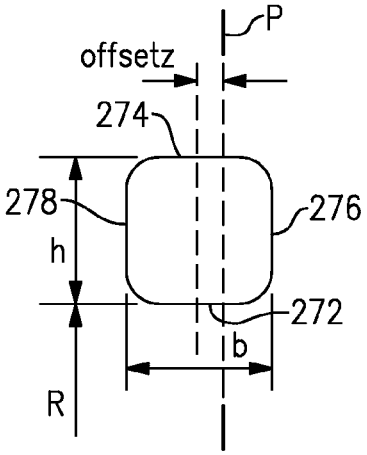
FIG. 12C is a cross-sectional view taken along line C-C in FIG. 11B.

The volute exit bend 260 is illustrated by the section C-C in FIG. 12C, which is provided by the inner and outer arcuate walls 272, 274 and the first and second axial walls 276, 278. The "offset Z" corresponds to the axial offset from the plane P in the Z-direction and is the axial midpoint between the first and second axial walls 276, 278. The diffuser 258 is defined by straight lines interconnecting section 0/36 from volute proper 256 to the "section 1" of the volute exit bend 260. The inner arcuate wall 272 in the diffuser 258 is normal to plane taken in the 0/360 section number, which is perpendicular to the flow direction. The inner arcuate wall 272 in the volute exit bend 260 lies along a radius R in the volute exit bend 260 rather than in the radius "r base." The sections are provided at section numbers taken at degree locations "beta." The corners of this quadrangular cross-section may include a radius, which in one example 0.156 inch (3.97 mm).

Tables N-1, N-2 and N-3 defining the volute and exit bend geometry provide the values for the critical dimensions in accordance with FIG. 7A-12C to four decimal points. The dimension provided in the Tables are subject to typical manufacturing tolerances of +/−0.010 inches on surface profile which have been considered and deemed acceptable to maintain the mechanical and aerodynamic function of these components. Thus, the mechanical and aerodynamic functions of the component are not impaired by manufacturing imperfections and tolerances, which in different embodiments may be greater or lesser than the values set forth in the disclosed Tables. As appreciated by those skilled in the art, manufacturing tolerances may be determined to achieve a desired mean and standard deviation of manufactured components in relation to the ideal component profile points set forth in the disclosed Tables.

TABLE 1-1

| Section number | Alpha [deg] | r base/D2 [in] | h/D2 [in] | b/D2 [in] |
|---|---|---|---|---|
| 0 | 0 | | | |
| 1 | 10 | 0.5123 | 0.0255 | 0.0789 |
| 2 | 20 | 0.5123 | 0.0295 | 0.0789 |
| 3 | 30 | 0.5123 | 0.0335 | 0.0789 |
| 4 | 40 | 0.5123 | 0.0375 | 0.0789 |
| 5 | 50 | 0.5123 | 0.0416 | 0.0789 |
| 6 | 60 | 0.5123 | 0.0458 | 0.0789 |
| 7 | 70 | 0.5123 | 0.0499 | 0.0789 |
| 8 | 80 | 0.5123 | 0.0542 | 0.0789 |
| 9 | 90 | 0.5123 | 0.0584 | 0.0789 |
| 10 | 100 | 0.5123 | 0.0627 | 0.0789 |
| 11 | 110 | 0.5123 | 0.0671 | 0.0789 |
| 12 | 120 | 0.5123 | 0.0715 | 0.0789 |
| 13 | 130 | 0.5123 | 0.0759 | 0.0789 |
| 14 | 140 | 0.5123 | 0.0804 | 0.0789 |
| 15 | 150 | 0.5123 | 0.0849 | 0.0789 |
| 16 | 160 | 0.5123 | 0.0895 | 0.0789 |
| 17 | 170 | 0.5123 | 0.0941 | 0.0789 |
| 18 | 180 | 0.5123 | 0.0987 | 0.0789 |
| 19 | 190 | 0.5123 | 0.1035 | 0.0789 |
| 20 | 200 | 0.5123 | 0.1082 | 0.0789 |
| 21 | 210 | 0.5123 | 0.1130 | 0.0789 |
| 22 | 220 | 0.5123 | 0.1179 | 0.0789 |

TABLE 1-2

| Section number | Alpha [deg] | r base/D2 [in] | b1/D2 [in] | b2/D2 [in] | h1/D2 [in] | h2/D2 [in] |
|---|---|---|---|---|---|---|
| 22 | 220 | 0.5123 | 0.0789 | 0.0793 | 0.1179 | 0.0868 |
| 23 | 230 | 0.5123 | 0.0789 | 0.0830 | 0.1183 | 0.0868 |
| 24 | 240 | 0.5123 | 0.0789 | 0.0868 | 0.1188 | 0.0868 |
| 25 | 250 | 0.5123 | 0.0789 | 0.0906 | 0.1192 | 0.0868 |
| 26 | 260 | 0.5123 | 0.0789 | 0.0944 | 0.1197 | 0.0868 |
| 27 | 270 | 0.5123 | 0.0789 | 0.0982 | 0.1201 | 0.0868 |
| 28 | 280 | 0.5123 | 0.0789 | 0.1021 | 0.1206 | 0.0868 |
| 29 | 290 | 0.5123 | 0.0789 | 0.1059 | 0.1210 | 0.0868 |
| 30 | 300 | 0.5123 | 0.0789 | 0.1098 | 0.1214 | 0.0868 |
| 31 | 310 | 0.5123 | 0.0789 | 0.1137 | 0.1219 | 0.0868 |
| 32 | 320 | 0.5123 | 0.0789 | 0.1176 | 0.1223 | 0.0868 |
| 33 | 330 | 0.5123 | 0.0789 | 0.1215 | 0.1228 | 0.0868 |
| 34 | 340 | 0.5123 | 0.0789 | 0.1255 | 0.1232 | 0.0868 |
| 35 | 350 | 0.5123 | 0.0789 | 0.1294 | 0.1237 | 0.0868 |
| 36 | 360 | 0.5123 | 0.0789 | 0.1334 | 0.1241 | 0.0868 |

TABLE 1-3

| Section number | Beta [deg] | R/D2 [in] | b/D2 [in] | h/D2 [in] | offset z/D2 [in] |
|---|---|---|---|---|---|
| 1 | 3.75 | 0.2667 | 0.1800 | 0.1383 | 0.0000 |
| 2 | 7.50 | 0.2667 | 0.1801 | 0.1433 | 0.0001 |
| 3 | 11.25 | 0.2667 | 0.1802 | 0.1483 | 0.0002 |
| 4 | 15.00 | 0.2667 | 0.1804 | 0.1533 | 0.0004 |
| 5 | 18.75 | 0.2667 | 0.1808 | 0.1583 | 0.0008 |
| 6 | 22.50 | 0.2667 | 0.1814 | 0.1633 | 0.0014 |
| 7 | 26.25 | 0.2667 | 0.1823 | 0.1683 | 0.0023 |
| 8 | 30.00 | 0.2667 | 0.1834 | 0.1733 | 0.0034 |
| 9 | 33.75 | 0.2667 | 0.1849 | 0.1783 | 0.0049 |
| 10 | 37.50 | 0.2667 | 0.1867 | 0.1833 | 0.0067 |
| 11 | 41.25 | 0.2667 | 0.1889 | 0.1883 | 0.0089 |
| 12 | 45.00 | 0.2667 | 0.1915 | 0.1933 | 0.0115 |
| 13 | 48.75 | 0.2667 | 0.1946 | 0.1983 | 0.0146 |
| 14 | 52.50 | 0.2667 | 0.1983 | 0.2033 | 0.0183 |
| 15 | 56.25 | 0.2667 | 0.2025 | 0.2083 | 0.0225 |
| 16 | 60.00 | 0.2667 | 0.2073 | 0.2133 | 0.0273 |
| 17 | 63.75 | 0.2667 | 0.2128 | 0.2183 | 0.0328 |
| 18 | 67.50 | 0.2667 | 0.2189 | 0.2233 | 0.0389 |
| 19 | 71.25 | 0.2667 | 0.2257 | 0.2283 | 0.0457 |
| 20 | 75.00 | 0.2667 | 0.2333 | 0.2333 | 0.0533 |

TABLE 2

| Section number | Alpha [deg] | r base/D2 [in] | h/D2 [in] | b/D2 [in] |
|---|---|---|---|---|
| 0 | 0 | | | |
| 1 | 10 | 0.5000 | 0.0003 | 0.0579 |
| 2 | 15 | 0.5000 | 0.0014 | 0.0579 |
| 3 | 20 | 0.5000 | 0.0026 | 0.0579 |
| 4 | 25 | 0.5000 | 0.0038 | 0.0579 |
| 5 | 30 | 0.5000 | 0.0050 | 0.0579 |
| 6 | 35 | 0.5000 | 0.0062 | 0.0579 |
| 7 | 40 | 0.5000 | 0.0074 | 0.0579 |
| 8 | 45 | 0.5000 | 0.0086 | 0.0579 |
| 9 | 50 | 0.5000 | 0.0099 | 0.0579 |
| 10 | 55 | 0.5000 | 0.0111 | 0.0579 |
| 11 | 60 | 0.5000 | 0.0124 | 0.0579 |
| 12 | 65 | 0.5000 | 0.0137 | 0.0579 |
| 13 | 70 | 0.5000 | 0.0150 | 0.0579 |
| 14 | 75 | 0.5000 | 0.0163 | 0.0579 |
| 15 | 80 | 0.5000 | 0.0177 | 0.0579 |
| 16 | 85 | 0.5000 | 0.0190 | 0.0579 |
| 17 | 90 | 0.5000 | 0.0204 | 0.0579 |
| 18 | 95 | 0.5000 | 0.0218 | 0.0579 |
| 19 | 100 | 0.5000 | 0.0232 | 0.0579 |
| 20 | 105 | 0.5000 | 0.0246 | 0.0579 |
| 21 | 110 | 0.5000 | 0.0260 | 0.0579 |
| 22 | 115 | 0.5000 | 0.0275 | 0.0579 |
| 23 | 120 | 0.5000 | 0.0289 | 0.0579 |
| 24 | 125 | 0.5000 | 0.0304 | 0.0579 |
| 25 | 130 | 0.5000 | 0.0319 | 0.0579 |
| 26 | 135 | 0.5000 | 0.0335 | 0.0579 |
| 27 | 140 | 0.5000 | 0.0350 | 0.0579 |
| 28 | 145 | 0.5000 | 0.0366 | 0.0579 |
| 29 | 150 | 0.5000 | 0.0382 | 0.0579 |
| 30 | 155 | 0.5000 | 0.0398 | 0.0579 |
| 31 | 160 | 0.5000 | 0.0414 | 0.0579 |
| 32 | 165 | 0.5000 | 0.0431 | 0.0579 |
| 33 | 170 | 0.5000 | 0.0447 | 0.0579 |
| 34 | 175 | 0.5000 | 0.0464 | 0.0579 |
| 35 | 180 | 0.5000 | 0.0481 | 0.0579 |
| 36 | 185 | 0.5000 | 0.0499 | 0.0579 |
| 37 | 190 | 0.5000 | 0.0516 | 0.0579 |
| 38 | 195 | 0.5000 | 0.0534 | 0.0579 |
| 39 | 200 | 0.5000 | 0.0552 | 0.0579 |
| 40 | 205 | 0.5000 | 0.0571 | 0.0579 |
| 41 | 210 | 0.5000 | 0.0589 | 0.0579 |
| 42 | 215 | 0.5000 | 0.0608 | 0.0579 |
| 43 | 220 | 0.5000 | 0.0627 | 0.0579 |
| 44 | 225 | 0.5000 | 0.0647 | 0.0579 |
| 45 | 230 | 0.5000 | 0.0666 | 0.0579 |
| 46 | 235 | 0.5000 | 0.0686 | 0.0579 |
| 47 | 240 | 0.5000 | 0.0706 | 0.0579 |

TABLE 2-continued

| Section number | Alpha [deg] | r base/D2 [in] | h/D2 [in] | b/D2 [in] |
|---|---|---|---|---|
| 48 | 245 | 0.5000 | 0.0727 | 0.0579 |
| 49 | 250 | 0.5000 | 0.0748 | 0.0579 |

TABLE 2-2

| Section number | Alpha [deg] | r base/D2 [in] | b1/D2 [in] | b2/D2 [in] | h1/D2 [in] | h2/D2 [in] |
|---|---|---|---|---|---|---|
| 50 | 255 | 0.5000 | 0.0579 | 0.0588 | 0.0769 | 0.0639 |
| 51 | 260 | 0.5000 | 0.0579 | 0.0608 | 0.0791 | 0.0670 |
| 52 | 265 | 0.5000 | 0.0579 | 0.0629 | 0.0796 | 0.0674 |
| 53 | 270 | 0.5000 | 0.0579 | 0.0647 | 0.0800 | 0.0679 |
| 54 | 275 | 0.5000 | 0.0579 | 0.0664 | 0.0805 | 0.0684 |
| 55 | 280 | 0.5000 | 0.0579 | 0.0683 | 0.0810 | 0.0689 |
| 56 | 285 | 0.5000 | 0.0579 | 0.0701 | 0.0815 | 0.0693 |
| 57 | 290 | 0.5000 | 0.0579 | 0.0720 | 0.0820 | 0.0698 |
| 58 | 295 | 0.5000 | 0.0579 | 0.0738 | 0.0825 | 0.0703 |
| 59 | 300 | 0.5000 | 0.0579 | 0.0756 | 0.0829 | 0.0708 |
| 60 | 305 | 0.5000 | 0.0579 | 0.0774 | 0.0834 | 0.0708 |
| 61 | 310 | 0.5000 | 0.0579 | 0.0792 | 0.0839 | 0.0714 |
| 62 | 315 | 0.5000 | 0.0579 | 0.0809 | 0.0844 | 0.0723 |
| 63 | 320 | 0.5000 | 0.0579 | 0.0826 | 0.0849 | 0.0727 |
| 64 | 325 | 0.5000 | 0.0579 | 0.0858 | 0.0854 | 0.0732 |
| 65 | 330 | 0.5000 | 0.0579 | 0.0874 | 0.0858 | 0.0737 |
| 66 | 335 | 0.5000 | 0.0579 | 0.0889 | 0.0863 | 0.0742 |
| 67 | 340 | 0.5000 | 0.0579 | 0.0903 | 0.0868 | 0.0746 |
| 68 | 345 | 0.5000 | 0.0579 | 0.0918 | 0.0873 | 0.0751 |
| 69 | 350 | 0.5000 | 0.0579 | 0.0931 | 0.0878 | 0.0757 |
| 70 | 355 | 0.5000 | 0.0579 | 0.0945 | 0.0882 | 0.0757 |
| 71 | 360 | 0.5000 | 0.0579 | 0.0957 | 0.0887 | 0.0789 |

TABLE 2-3

| Section number | Beta [deg] | R/D2 [in] | b/D2 [in] | h/D2 [in] | offset z/D2 [in] |
|---|---|---|---|---|---|
| 1 | 3.50 | 0.2676 | 0.1555 | 0.1141 | 0.0000 |
| 2 | 7.00 | 0.2676 | 0.1556 | 0.1161 | 0.0001 |
| 3 | 10.50 | 0.2676 | 0.1557 | 0.1183 | 0.0005 |
| 4 | 14.00 | 0.2676 | 0.1559 | 0.1207 | 0.0011 |
| 5 | 17.50 | 0.2676 | 0.1563 | 0.1233 | 0.0022 |
| 6 | 21.00 | 0.2676 | 0.1569 | 0.1260 | 0.0037 |
| 7 | 24.50 | 0.2676 | 0.1577 | 0.1288 | 0.0059 |
| 8 | 28.00 | 0.2676 | 0.1588 | 0.1317 | 0.0088 |
| 9 | 31.50 | 0.2676 | 0.1602 | 0.1347 | 0.0126 |
| 10 | 35.00 | 0.2676 | 0.1619 | 0.1378 | 0.0172 |
| 11 | 38.50 | 0.2676 | 0.1641 | 0.1410 | 0.0229 |
| 12 | 42.00 | 0.2676 | 0.1666 | 0.1442 | 0.0298 |
| 13 | 45.50 | 0.2676 | 0.1696 | 0.1476 | 0.0379 |
| 14 | 49.00 | 0.2676 | 0.1731 | 0.1509 | 0.0473 |
| 15 | 52.50 | 0.2676 | 0.1772 | 0.1544 | 0.0582 |
| 16 | 56.00 | 0.2676 | 0.1818 | 0.1579 | 0.0706 |
| 17 | 59.50 | 0.2676 | 0.1871 | 0.1614 | 0.0847 |
| 18 | 63.00 | 0.2676 | 0.1930 | 0.1650 | 0.1006 |
| 19 | 66.50 | 0.2676 | 0.1996 | 0.1687 | 0.1183 |
| 20 | 70.00 | 0.2676 | 0.2069 | 0.1724 | 0.1379 |

TABLE 3-1

| Section number | Alpha [deg] | r base/D2 [in] | h/D2 [in] | b/D2 [in] |
|---|---|---|---|---|
| 1 | 10 | 0.5000 | 0.0010 | 0.0863 |
| 2 | 15 | 0.5000 | 0.0029 | 0.0863 |
| 3 | 20 | 0.5000 | 0.0046 | 0.0863 |
| 4 | 25 | 0.5000 | 0.0061 | 0.0863 |
| 5 | 30 | 0.5000 | 0.0075 | 0.0863 |
| 6 | 35 | 0.5000 | 0.0088 | 0.0863 |
| 7 | 40 | 0.5000 | 0.0100 | 0.0863 |
| 8 | 45 | 0.5000 | 0.0111 | 0.0863 |

TABLE 3-1-continued

| Section number | Alpha [deg] | r base/D2 [in] | h/D2 [in] | b/D2 [in] |
|---|---|---|---|---|
| 9 | 50 | 0.5000 | 0.0123 | 0.0863 |
| 10 | 55 | 0.5000 | 0.0134 | 0.0863 |
| 11 | 60 | 0.5000 | 0.0145 | 0.0863 |
| 12 | 65 | 0.5000 | 0.0155 | 0.0863 |
| 13 | 70 | 0.5000 | 0.0166 | 0.0863 |
| 14 | 75 | 0.5000 | 0.0176 | 0.0863 |
| 15 | 80 | 0.5000 | 0.0186 | 0.0863 |
| 16 | 85 | 0.5000 | 0.0196 | 0.0863 |
| 17 | 90 | 0.5000 | 0.0206 | 0.0863 |
| 18 | 95 | 0.5000 | 0.0216 | 0.0863 |
| 19 | 100 | 0.5000 | 0.0226 | 0.0863 |
| 20 | 105 | 0.5000 | 0.0236 | 0.0863 |
| 21 | 110 | 0.5000 | 0.0246 | 0.0863 |
| 22 | 115 | 0.5000 | 0.0255 | 0.0863 |
| 23 | 120 | 0.5000 | 0.0266 | 0.0863 |
| 24 | 125 | 0.5000 | 0.0275 | 0.0863 |
| 25 | 130 | 0.5000 | 0.0285 | 0.0863 |
| 26 | 135 | 0.5000 | 0.0295 | 0.0863 |
| 27 | 140 | 0.5000 | 0.0305 | 0.0863 |
| 28 | 145 | 0.5000 | 0.0315 | 0.0863 |
| 29 | 150 | 0.5000 | 0.0325 | 0.0863 |
| 30 | 155 | 0.5000 | 0.0336 | 0.0863 |
| 31 | 160 | 0.5000 | 0.0346 | 0.0863 |
| 32 | 165 | 0.5000 | 0.0356 | 0.0863 |
| 33 | 170 | 0.5000 | 0.0366 | 0.0863 |
| 34 | 175 | 0.5000 | 0.0377 | 0.0863 |
| 35 | 180 | 0.5000 | 0.0387 | 0.0863 |
| 36 | 185 | 0.5000 | 0.0398 | 0.0863 |
| 37 | 190 | 0.5000 | 0.0409 | 0.0863 |
| 38 | 195 | 0.5000 | 0.0420 | 0.0863 |

TABLE 3-2

| Section number | Alpha [deg] | r base/D2 [in] | h/D2 [in] | b/D2 [in] |
|---|---|---|---|---|
| 39 | 200 | 0.5000 | 0.0431 | 0.0863 |
| 40 | 205 | 0.5000 | 0.0442 | 0.0863 |
| 41 | 210 | 0.5000 | 0.0453 | 0.0863 |
| 42 | 215 | 0.5000 | 0.0465 | 0.0863 |
| 43 | 220 | 0.5000 | 0.0477 | 0.0863 |
| 44 | 225 | 0.5000 | 0.0488 | 0.0863 |
| 45 | 230 | 0.5000 | 0.0500 | 0.0863 |
| 46 | 235 | 0.5000 | 0.0512 | 0.0863 |
| 47 | 240 | 0.5000 | 0.0525 | 0.0863 |
| 48 | 245 | 0.5000 | 0.0537 | 0.0863 |
| 49 | 250 | 0.5000 | 0.0550 | 0.0863 |
| 50 | 255 | 0.5000 | 0.0562 | 0.0863 |
| 51 | 260 | 0.5000 | 0.0575 | 0.0863 |
| 52 | 265 | 0.5000 | 0.0589 | 0.0863 |
| 53 | 270 | 0.5000 | 0.0602 | 0.0863 |
| 54 | 275 | 0.5000 | 0.0615 | 0.0863 |
| 55 | 280 | 0.5000 | 0.0629 | 0.0863 |
| 56 | 285 | 0.5000 | 0.0643 | 0.0863 |
| 57 | 290 | 0.5000 | 0.0657 | 0.0863 |
| 58 | 295 | 0.5000 | 0.0671 | 0.0863 |
| 59 | 300 | 0.5000 | 0.0686 | 0.0863 |
| 60 | 305 | 0.5000 | 0.0700 | 0.0863 |
| 61 | 310 | 0.5000 | 0.0715 | 0.0863 |
| 62 | 315 | 0.5000 | 0.0730 | 0.0863 |
| 63 | 320 | 0.5000 | 0.0746 | 0.0863 |
| 64 | 325 | 0.5000 | 0.0761 | 0.0863 |
| 65 | 330 | 0.5000 | 0.0777 | 0.0863 |
| 66 | 335 | 0.5000 | 0.0793 | 0.0863 |
| 67 | 340 | 0.5000 | 0.0810 | 0.0863 |
| 68 | 345 | 0.5000 | 0.0826 | 0.0863 |
| 69 | 350 | 0.5000 | 0.0843 | 0.0863 |
| 70 | 355 | 0.5000 | 0.0860 | 0.0863 |
| 71 | 360 | 0.5000 | 0.0877 | 0.0863 |

TABLE 3-3

| Section number | Beta [deg] | R/D2 [in] | b/D2 [in] | h/D2 [in] | offset z/D2 [in] |
|---|---|---|---|---|---|
| 1 | 2.50 | 0.271 | 0.1354 | 0.1419 | 0.0000 |
| 2 | 5.00 | 0.269 | 0.1391 | 0.1452 | 0.0001 |
| 3 | 7.50 | 0.267 | 0.1427 | 0.1486 | 0.0005 |
| 4 | 10.00 | 0.265 | 0.1464 | 0.1519 | 0.0011 |
| 5 | 12.50 | 0.263 | 0.1500 | 0.1552 | 0.0021 |
| 6 | 15.00 | 0.261 | 0.1537 | 0.1585 | 0.0037 |
| 7 | 17.50 | 0.259 | 0.1574 | 0.1618 | 0.0059 |
| 8 | 20.00 | 0.257 | 0.1610 | 0.1651 | 0.0087 |
| 9 | 22.50 | 0.255 | 0.1647 | 0.1684 | 0.0124 |
| 10 | 25.00 | 0.253 | 0.1683 | 0.1718 | 0.0171 |
| 11 | 27.50 | 0.251 | 0.1720 | 0.1751 | 0.0227 |
| 12 | 30.00 | 0.249 | 0.1757 | 0.1784 | 0.0295 |
| 13 | 32.50 | 0.247 | 0.1793 | 0.1817 | 0.0375 |
| 14 | 35.00 | 0.245 | 0.1830 | 0.1850 | 0.0469 |
| 15 | 37.50 | 0.242 | 0.1866 | 0.1883 | 0.0576 |
| 16 | 40.00 | 0.240 | 0.1903 | 0.1917 | 0.0699 |
| 17 | 42.50 | 0.238 | 0.1939 | 0.1950 | 0.0839 |
| 18 | 45.00 | 0.236 | 0.1976 | 0.1983 | 0.0996 |
| 19 | 47.50 | 0.234 | 0.2013 | 0.2016 | 0.1171 |
| 20 | 50.00 | 0.232 | 0.2049 | 0.2049 | 0.1366 |

Although an example embodiment has been disclosed, a worker of ordinary skill in this art would recognize that certain modifications would come within the scope of the claims. For that reason, the following claims should be studied to determine their true scope and content.

What is claimed is:

1. A centrifugal boost pump volute comprising:

a housing providing normal to flow cross sectional surfaces distributed over a length of the volute defining a fluid passage, the volute includes a volute proper, an exit bend and a diffuser fluidly interconnecting the volute proper to the exit bend, the cross sectional surfaces are defined as dimensions set out in one set of data, which includes Tables N-1 and N-2 for the volute proper and Table N-3 for the volute exit bend, where N is the same value.

2. The centrifugal boost pump volute according to claim 1, wherein the housing is provided by first and second housing portions that mate with one another along a plane, the plane lying within the volute.

3. The centrifugal boost pump volute according to claim 2, wherein the first housing portion provides a central opening in fluid communication with the volute.

4. The centrifugal boost pump volute according to claim 3, comprising an impeller arranged within the housing, the volute circumscribing the impeller, and the impeller including an inducer arranged within the opening.

5. The centrifugal boost pump comprising:

a housing including a central opening;

a volute arranged in the housing in fluid communication with the central opening and providing normal to flow cross sectional surfaces distributed over a length of the volute defining a fluid passage, the volute includes a volute proper, an exit bend and a diffuser fluidly interconnecting the volute proper to the exit bend, the cross sectional surfaces are defined as dimensions set out in one set of data, which includes Tables N-1 and N-2 for the volute proper and Table N-3 for the volute exit bend, where N is the same value; and an impeller arranged in the housing and including impeller and inducer sections, the impeller having a perimeter and the volute circumscribing the perimeter, the inducer section provided in the central opening.

6. The centrifugal boost pump according to claim 5, wherein the housing is provided by first and second housing portions that mate with one another along a plane, the plane lying within the volute.

7. A method of manufacturing a centrifugal boost pump volute comprising:

providing a passage in a housing with normal to flow cross sectional surfaces distributed over a length of the volute defining a fluid passage, the volute includes a volute proper, an exit bend and a diffuser fluidly interconnecting the volute proper to the exit bend, the cross sectional surfaces are defined as dimensions set out in one set of data, which includes Tables N-1 and N-2 for the volute proper and Table N-3 for the volute exit bend, where N is the same value.

8. The method according to claim 7, wherein the providing step includes milling the passage into a housing, wherein the housing includes at least first and second housing portions.

9. A method of assembling a centrifugal boost pump comprising:

fastening first and second housing portions about an impeller, wherein the first and second housing portions provide a volute circumscribing the impeller, the volute including normal to flow cross sectional surfaces distributed over a length of the volute defining a fluid passage, the volute includes a volute proper, an exit bend and a diffuser fluidly interconnecting the volute proper to the exit bend, the cross sectional surfaces are defined as dimensions set out in one set of data, which includes Tables N-1 and N-2 for the volute proper and Table N-3 for the volute exit bend, where N is the same value.

* * * * *